US009532663B2

(12) United States Patent
Nilsson

(10) Patent No.: US 9,532,663 B2
(45) Date of Patent: Jan. 3, 2017

(54) HOLDING DEVICE

(71) Applicant: Elfa International AB, Vastervik (SE)

(72) Inventor: Peter Nilsson, Vastervik (SE)

(73) Assignee: ELFA INTERNATIONAL AB (SE)

( * ) Notice: Subject to any disclaimer, the term of this patent is extended or adjusted under 35 U.S.C. 154(b) by 0 days.

(21) Appl. No.: 14/407,822

(22) PCT Filed: Jun. 14, 2013

(86) PCT No.: PCT/SE2013/050692
§ 371 (c)(1),
(2) Date: Dec. 12, 2014

(87) PCT Pub. No.: WO2013/191623
PCT Pub. Date: Dec. 27, 2013

(65) Prior Publication Data

US 2015/0150389 A1 Jun. 4, 2015

(30) Foreign Application Priority Data

Jun. 19, 2012 (SE) ..... 1250650-7

(51) Int. Cl.
*A47B 96/06* (2006.01)
*A47G 29/00* (2006.01)
(Continued)

(52) U.S. Cl.
CPC ..... *A47F 5/0823* (2013.01); *B25H 3/04* (2013.01); *A47B 57/16* (2013.01); *A47B 57/40* (2013.01);
(Continued)

(58) Field of Classification Search
CPC ..... A45F 5/00; B60P 7/0823; A47F 5/0006; A47F 5/101; A47F 5/0823; A47F 5/0807; A47F 5/0815; A47F 5/083; A47F 5/08; A47G 1/20;F16B 45/00; Y10T 24/3485; A47B 57/16; A47B 57/20; A47B 57/40; A47B 57/406; A47B 57/48; A47B 57/482; A47B 57/485; A47B 96/1408; A47B 96/1433; A47B 57/42; A47B 57/52; A47B 96/061
(Continued)

(56) References Cited

U.S. PATENT DOCUMENTS 1,030,425 A * 6/1912 Owen ..... 69/21
2,790,616 A 4/1957 Cardinal, Jr.
(Continued)

FOREIGN PATENT DOCUMENTS

CN 2486055 Y 4/2002
CN 101574194 A 11/2009
(Continued)

*Primary Examiner* — Terrell McKinnon
*Assistant Examiner* — Michael McDuffie
(74) *Attorney, Agent, or Firm* — Condo Roccia Koptiw LLP

(57) ABSTRACT

The present disclosure relates to a combination of a support device (1, 33) and a holding device (7), the support device comprising an attachment surface having rows (5) with elongated slot openings (3, 3'), and the holding device comprising an attachment part (9) and a carrier part (11). The attachment part is intended to be attached to the support device by being partly inserted into a first slot (3), such that the holding device can take up a load directed in the plane of attachment surface, and the carrier part (11) being capable of supporting an item to be stored. A stem part (13) interconnects the attachment part and the carrier part and the stem part includes a fin (15) that fits into a second slot (3') which is located under said first slot (3). This provides a more reliable connection to the support device. A holding device suitable for this combination is also considered.

20 Claims, 3 Drawing Sheets

(51) Int. Cl.

| | |
|---|---|
| ***A47K 1/00*** | (2006.01) |
| ***E04G 3/00*** | (2006.01) |
| ***E04G 5/06*** | (2006.01) |
| ***F21V 21/00*** | (2006.01) |
| ***F21V 35/00*** | (2006.01) |
| ***A47F 5/08*** | (2006.01) |
| ***B25H 3/04*** | (2006.01) |
| *A47B 96/14* | (2006.01) |
| *A47B 57/16* | (2006.01) |
| *A47B 57/40* | (2006.01) |

(52) U.S. Cl.
CPC ..... *A47B 96/1408* (2013.01); *A47F 5/08* (2013.01); *Y10T 29/49826* (2015.01)

(58) Field of Classification Search
USPC ..... 248/690, 692, 220.31, 220.41, 220.42,248/221.11, 301, 304, 339, 231.9; 211/59.1, 211/57.1, 192, 94.01, 106.01, 190, 191, 187
See application file for complete search history.

(56) References Cited

U.S. PATENT DOCUMENTS

| | | | | |
|---|---|---|---|---|
| 2,841,353 | A * | 7/1958 | Burdick | 248/220.21 |
| 3,259,209 | A | 7/1966 | Brown | |
| 3,310,271 | A | 3/1967 | King | |
| 3,313,863 | A | 4/1967 | Schnell et al. | |
| 3,664,625 | A | 5/1972 | Price | |
| 4,105,179 | A | 8/1978 | Elliott | |
| 4,708,311 | A * | 11/1987 | Clausen et al. | 248/220.31 |
| 4,750,700 | A * | 6/1988 | Wade | A47F 5/0823 211/59.1 |
| 4,880,133 | A * | 11/1989 | Cullinane | 220/737 |
| 5,141,192 | A * | 8/1992 | Adams | 248/231.81 |
| 5,487,517 | A * | 1/1996 | Smith | 248/215 |
| 5,595,309 | A * | 1/1997 | Bauer et al. | 211/59.1 |
| 5,611,438 | A * | 3/1997 | Dye | A47F 5/0823 211/57.1 |
| 5,619,774 | A * | 4/1997 | Perry | 24/3.6 |
| 5,881,982 | A * | 3/1999 | Hollingsworth | A47F 5/0823 248/220.31 |
| 5,910,351 | A * | 6/1999 | Davis et al. | 428/100 |
| 6,299,001 | B1 * | 10/2001 | Frolov et al. | 211/106 |
| 6,499,608 | B1 | 12/2002 | Sterling et al. | |
| 6,530,486 | B1 * | 3/2003 | Batting | A47F 5/0823 211/57.1 |
| 6,860,456 | B2 * | 3/2005 | Magnusson | A47B 47/027 211/206 |
| 7,427,053 | B2 * | 9/2008 | Nawrocki | 248/220.21 |
| 7,694,925 | B2 * | 4/2010 | Kokenge et al. | 248/220.42 |
| 8,191,845 | B1 * | 6/2012 | Yu | 248/304 |
| 2005/0011844 | A1 | 1/2005 | Magnusson et al. | |
| 2007/0158517 | A1 * | 7/2007 | King | 248/301 |
| 2012/0126081 | A1 * | 5/2012 | Wengreen et al. | 248/304 |

FOREIGN PATENT DOCUMENTS

| | | | |
|---|---|---|---|
| CN | 202145546 | U | 2/2012 |
| DE | 10054945 | A1 | 5/2002 |
| FR | 2720790 | A1 | 12/1995 |
| FR | 2723620 | A1 | 2/1996 |
| GB | 2359010 | A | 8/2001 |

* cited by examiner

HOLDING DEVICE

This application is the National Stage entry under 35 U.S.C. §371 of PCT Application No. PCT/SE2013/050692, filed Jun. 14, 2013, which claims the benefit of Swedish Patent Application No. 1250650-7, filed Jun. 19, 2012, the disclosures of which are all herein incorporated by reference in their entirety.

TECHNICAL FIELD

The present disclosure relates to a holding device and a combination of a support device and such a holding device. The support device comprises an attachment surface having rows with elongated slot openings. The holding device comprises an attachment part and a carrier part, the attachment part being intended to be attached to the support device by being partly inserted into a first slot, such that the holding device can take up a load directed in the plane of attachment surface, and the carrier part being capable of supporting an item to be stored.

BACKGROUND

Different variations of such holding devices and support devices have been used for a long time. The support device may for instance be a sheet metal plate that is attached to a wall, and different holding devices can be attached at different locations over the plate, in different openings, such that a configuration desired by the user is achieved. Items of various kinds may then be stored on the sheet metal plate, e.g. tools.

One problem associated with such devices is to improve their reliablilty and usefulness.

SUMMARY

This object is achieved by a combination as defined in claim 1 and a holding device as defined in claim 7.

More specifically, the combination then includes a support device and a holding device, the support device comprising an attachment surface having rows with elongated slot openings. The holding device comprises an attachment part and a carrier part, the attachment part being intended to be attached to the support device by being partly inserted into a first slot such that the holding device can take up a load directed in the plane of attachment surface, and the carrier part being capable of supporting an item to be stored. A stem part interconnects the attachment part and the carrier part and the stem part includes a fin that fits into a second slot, which is located under the first slot, in the same row. Thanks to this configuration, it is prevented that the holding device swings sideways, pivoted at the attachment part. This provides a more reliable attachment.

The attachment part may be hook shaped, having a first leg extending substantially perpendicularly from the stem, and a second leg extending from the first leg and obliquely towards the stem, such that a triangular opening is formed between the stem, and the first and second legs. This allows the holding device to be readily attached to support devices with different thicknesses.

A projection may be formed close to the end of the second leg and extending towards the stem, and the distance between the projection and the first leg may correspond to the minimum distance between two adjacent openings in the carrier device. This locks the attached holding device to some extent as the projection may snap into the lower opening.

The carrier part may be e.g. in the form of a hook, a basket, a box or a tool holder.

A holding device suitable for such a combination is also considered.

DETAILED DESCRIPTION

The present disclosure relates in general to storage systems for storing items of different kinds.

Figure 1:
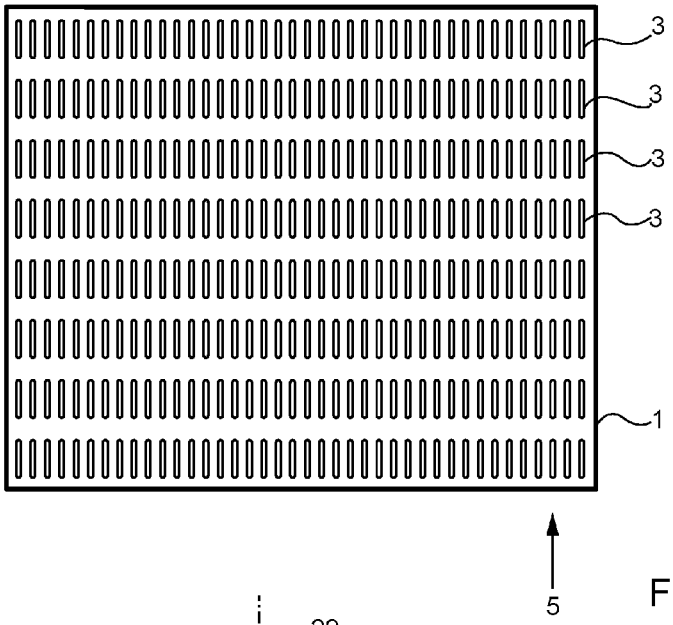
FIG. 1 shows a support device in the form of a support plate.

FIG. 1 shows a support device in the form of a support plate 1. The support plate 1 presents an attachment surface with a number of elongated slot openings 3 (in the illustrated case 8×40), which are arranged in rows 5, e.g. with a centre-centre distance of 10.5 mm between the rows. The elongated directions of the slots 3 are aligned with the rows 5. The slot length may be e.g. 20 mm and the width 3.5 mm. The plate 1 may for instance be 1.45 mm thick, and the elongated slot openings 3 are through holes. The support plate 1 may typically be wall mounted, for instance in a garage, and may be attached to a wall using bolts and distance elements (not shown) in such a way that there is e.g. a 25 mm distance between the wall and the support plate 1, which may extend more or less in parallel. The attachment surface is then substantially vertically oriented as is the rows of slots.

Figure 2:
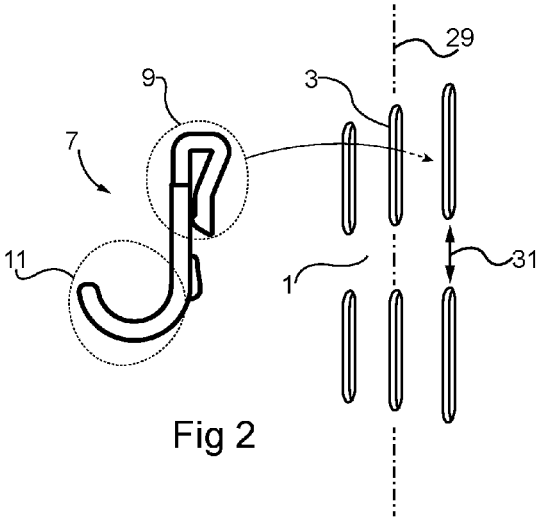
FIG. 2 illustrates how a holding device in the form of a hook can be attached to a support device in the form of a support plate.

FIG. 2 illustrates how a holding device in the form of a hook 7 can be attached to a support device in the form of a support plate 1. The hook 7 has an attachment part 9 and a carrier part 11, which is capable of supporting an item to be stored. In the illustrated case, the carrier part has a hook which defines the holding device as a whole as a hook. However, a number of other carrier part embodiments are possible as will be discussed later.

The attachment part 9, in the form of an attachment hook, is intended to be attached to the support plate 1 by being inserted into a slot 3 and being hooked over the lower edge of the slot 3, such that the holding device can take up a load directed downwards in the plane of attachment surface.

The holding device can easily be relocated to other slots, and a user can obtain many different configurations of holding devices on a support device.

Figure 3:
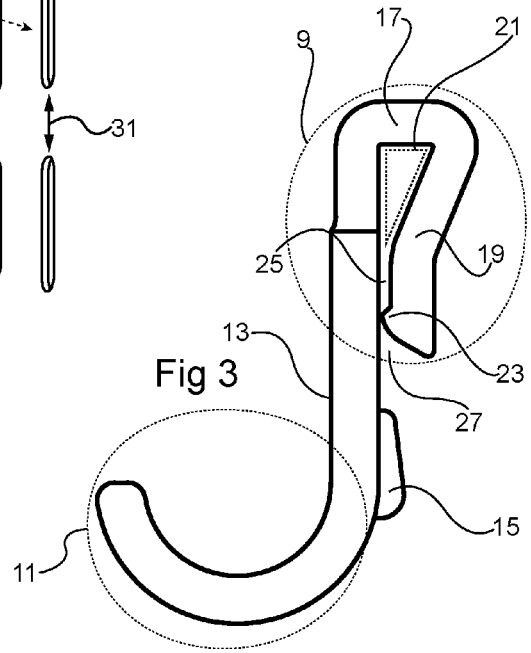
FIG. 3 illustrates details of the holding device in FIG. 2.

FIG. 3 illustrates details of the holding device in FIG. 2. The attachment part 9 and the carrier part 11 are interconnected by a stem part 13, which is intended to extend in parallel with the attachment surface of the support device 1, when attached.

The stem part 13 has a fin 15 which extends from the stem part in the direction facing the support device 1. This fin 15 may therefore extend into a support device opening 3, that is located under the opening in which the attachment part 9 is inserted, as will be shown in FIG. 4.

The attachment part 9, as mentioned, provides an attachment hook, which is formed by a first leg 17, which may be substantially perpendicular to the stem 13, extending in through a support device opening 3 when the holding device is mounted, and a second leg 19, which extends downwards behind the support device attachment surface when the holding device 7 is mounted. The second leg may be partly inclined towards the stem 13, as illustrated, such that a triangular opening 21 is formed between the stem 13, and the first and second legs 17, 19.

The end of the second leg 19 may include a projection 23, extending towards the stem, which more or less reaches the stem part 13. The first and second legs 17, 19 may be bent from the stem 13 in such a way that the second leg 19, close to the end thereof, is urged against the stem 13, but thanks to the projection 23 an elongated space 25, where there is a distance between the second leg 19 and the stem 13, is provided over the projection 23. Under the projection 23, the distance between the stem 13 and the second leg 19 may increase gradually to form a tapering space 27, that tapers towards the projection 23 to facilitate the attachment of the holding device to a support device.

Figure 4:
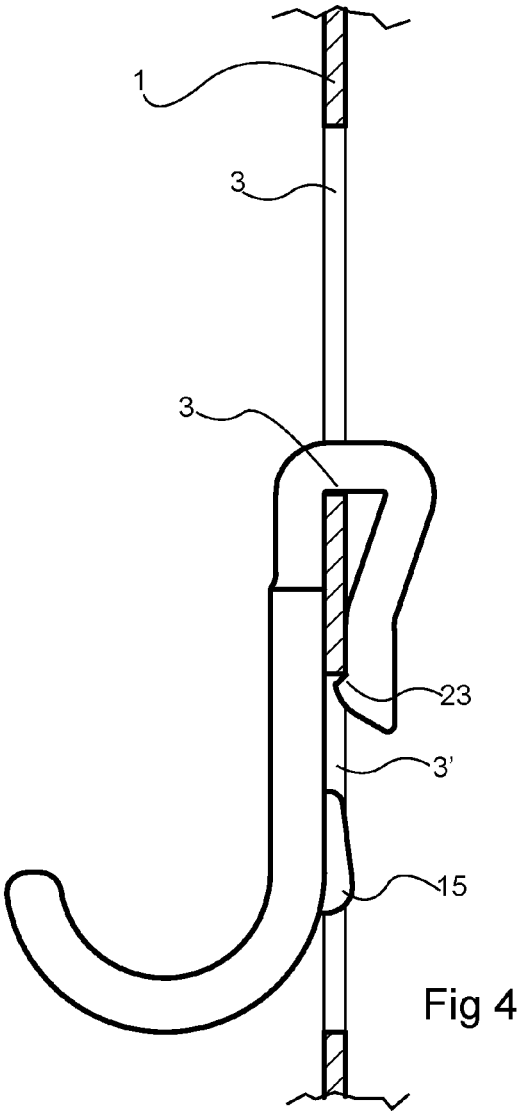
FIG. 4 shows a cross section through a support device with an attached holding device.
Figure 5:
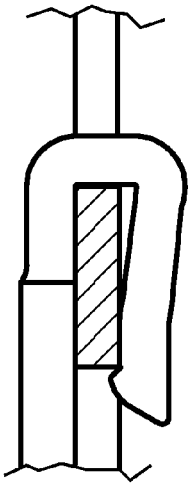
FIG. 5 illustrates a portion of a cross section corresponding to FIG. 4, but where a thicker support device is used.

FIG. 4 shows a cross section through a support device with an attached holding device. The location of the cross section 29 is indicated in FIG. 2. The hook/holding device is attached to a relatively thin support plate. In FIG. 5, a corresponding portion of the arrangement in FIG. 4 is shown, where a thicker support plate is used.

In FIG. 4, advantageous dimensioning of the attachment part of the holding device is illustrated, in relation to the support device. As can be seen, the distance between the projection 23 and the first leg 17 of the attachment part may correspond to the distance between two adjacent openings (cf. 31 in FIG. 2, e.g. 12 mm) in a row 5 of openings. This means that the projection 23 snaps into the opening 3' below the opening 3 in which the attachment part has been inserted. Thereby, the attachment part becomes somewhat locked from being moved upwards, such that the risk that the attachment part is accidently removed is reduced.

As can be seen in FIG. 4, the fin 15 of the stem part 13 is inserted into the above mentioned lower opening 3'. This prevents the carrier part 11 from swinging sideways, i.e. to be pivoted about the first leg of the attachment part, in parallel with the plane of the support device attachment surface. The fin thus has a width that is, at least partly, smaller than the width of the opening.

The triangular opening 21, formed by the first leg of the attachment part allows the attachment part to be fitted with support devices with different thicknesses as illustrated in FIG. 5.

Figure 6:
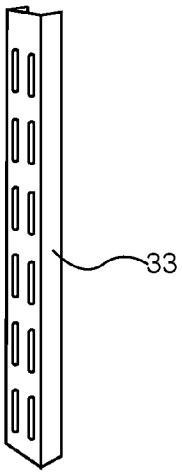
FIG. 6 shows an alternative example of a support device.

FIG. 6 shows another example of a support device, in form of a U-shaped rail element 33 having two vertical rows of elongated openings in the bottom part of the "U". Such a rail can be mounted extending vertically on a wall with the bottom part and the openings facing outwards in order to leave a free space between the openings and the wall. Alternatively, such a rail may be provided with as a free-standing arrangement. The rail element as such is well known, and is used e.g. to carry cantilevered consoles.

Figure 7:
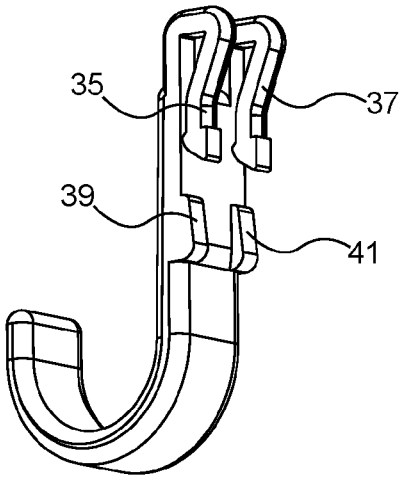
FIG. 7 shows a perspective view of an alternative holding device having a double attachment part.
Figure 8:
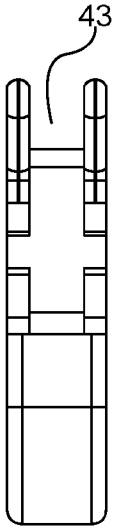
FIG. 8 is a plan view of the holding device in FIG. 7 as seen from a support plate.
Figure 9:
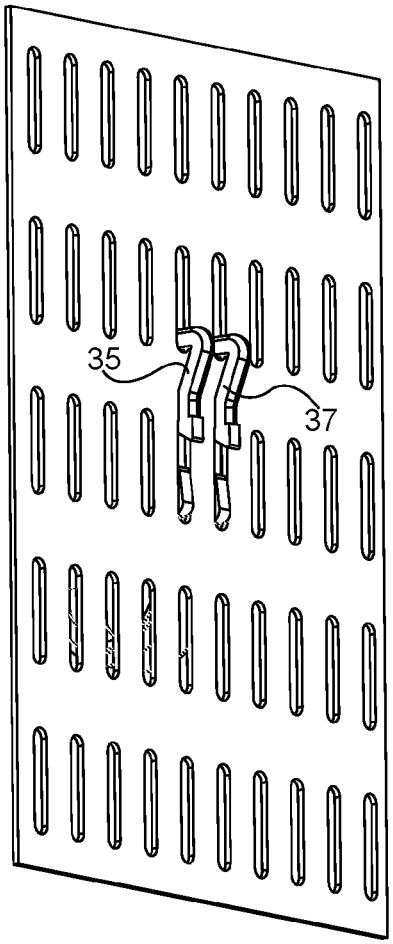
FIG. 9 shows the holding device of FIG. 7 when attached to a support plate.

FIG. 7 shows a perspective view of an alternative holding device having a double attachment part, including two legs 35, 37 and a stem with two fins 39, 41. This hook is wider and can carry a greater load. The legs 35, 37 have an intervening gap 43 at the top to allow the legs to be introduced in two slots in adjacent rows, as shown in FIG. 8. FIG. 9 shows, from the backside of the support device, the holding device of FIG. 7 when attached to a support plate. As can be seen, the distance between the legs of the attachment part corresponds to the distance between two adjacent slit rows.

The present disclosure is not restricted to the above illustrated embodiments and may be varied and altered in different ways within the scope of the appended claims.

For instance, the carrier part of the holding device, which when illustrated above is a single hook, may be be provided with alternative features such as multiple hooks, a basket, a box, or other carrier parts adapted e.g. to hold a tool of a certain kind. It is also possible to interconnect carrier parts of multiple holding devices.

The invention claimed is:

1. A method for assembling a suspension device, the method comprising:

inserting an attachment part of a hook into a first side of a support plate via a first slot in a column of two or more slots located on the support place, wherein the support plate comprises one or more of columns of slots, and the hook comprises the attachment part, a stem part, and a hook shaped carrier part, the stem part connecting the attachment part to the hook shaped carrier part; and a projection of the attachment part entering a second slot in the column of slots that includes the first slot, wherein the projection enters the second slot via an opposite side of the support plate from the first side, wherein projection part substantially abuts the stem of the hook through the second slot so as to stabilize the hook relative to the support plate.

2. The method as in claim 1, further comprising a fin of the stem part entering the second slot through the first side of the support plate.

3. The method as in claim 2, wherein the fin further stabilizes the hook relative to the support plate.

4. The method as in claim 1, wherein the attachment part comprises a first leg and a second leg, the first leg rests on the bottom of the first slot when the hook is inserted, the second leg comprises the projection, and at least a portion of the second leg contacts the opposite side of the support plate between the first and second slots.

5. The method as in claim 4, wherein a triangular opening is formed between the stem and the first and second legs of the attachment part.

6. The method as in claim 1, wherein the second slot is below the first slot in the column.

7. The method as in claim 1, wherein each of the slots in the column has a length that is several times longer than a width of the slots.

8. A suspension device comprising:

a support plate, wherein the support plate comprises a surface with one or more columns of elongated openings, each column including at least two elongated openings; and a hook comprising an attachment part, a stem part, and a hook shaped carrier part, the stem connecting the attachment part and the hook shaped carrier part, the attachment part being attachable to the support plate by being at least partly insertable into a first elongated opening in the support plate via a first side of the support plate, the attachment part comprising a first leg extending from the stem and a second leg extending from the first leg, wherein upon attachment of the attachment part to the support plate a projection of the second leg is configured to enter a second elongated opening of the support plate via a second side of the support plate and substantially abut the stem of the hook through the second elongated opening of the support plate while the first leg is positioned in the first elongated opening such that the hook is stabilized relative to the support plate.

9. The suspension device as in claim 8, wherein the stem further comprises a fin, and the fin is configured to enter the second elongated opening through the first side of the support plate.

10. The suspension device as in claim 9 wherein the fin is configured to further stabilize the hook relative to the support plate.

11. The suspension device as in claim 10, wherein the first leg of the attachment part is configured to rest on the bottom of the first elongated opening, and at least a portion of the second leg is configured to contact the second side of the support plate between the first and second elongated openings.

12. The suspension device as in claim 11, wherein the stem, the first leg, and the second leg are configured such that a triangular opening is formed between the stem, the first leg, and the second leg.

13. The suspension device as in claim 8, wherein the second elongated opening is below the first elongated opening in a column of elongated openings.

14. The suspension device as in claim 8, wherein each of the slots in the column has a length that is several times longer than a width of the slots.

15. A hook that is attachable to a support plate having one or more columns of elongated openings, the hook comprising:

a hook shaped carrier part;

a stem configured to connect the hook shaped carrier part to an attachment part; and the attachment part, wherein attachment part is configured to be attachable to the support plate via a first leg and a second leg, the second leg extending from the first leg, wherein the stem, the first leg, and the second leg are configured such that a triangular opening is formed between the stem, the first leg, and the second leg, wherein a projection of the second leg is configured to substantially abut the stem of the hook, wherein upon the hook being affixed to the support plate the first leg is positioned in a first elongated opening and the projection of the second leg substantially abuts the stem through a second elongated opening in the same column as the first elongated opening.

16. The hook as in claim 15, wherein the stem further comprises a fin, and the fin is configured to enter the second elongated opening through an opposite side of the support plate relative to a side of the support plate at which the projection is configured to enter the second elongated opening.

17. The hook as in claim 15, wherein the fin is configured to further stabilize the hook relative to the support plate.

18. The hook as in claim 15, wherein each of the first leg and second leg comprise a gap that separates a first portion of the first leg from a second portion of the first leg and that separates a first portion of the second leg from a second portion of the second leg.

19. The hook as in claim 18, wherein the first and second portions of the first leg are configured to enter different elongated openings in a first row of elongated openings when affixed to the support plate.

20. The hook as in claim 19, wherein the first and second portions of the second leg are configured to enter different elongated openings in a second row of elongated openings when affixed to the support plate, wherein the second row is below the first row.

* * * * *